US012342901B2

(12) United States Patent
Yamada

(10) Patent No.: US 12,342,901 B2
(45) Date of Patent: Jul. 1, 2025

(54) INSOLE

(71) Applicants: RACINE CO., LTD., Tokyo (JP); LEADING DRAGON TRADING LIMITED, Hong Kong (CN)

(72) Inventor: Masahiro Yamada, Tokyo (JP)

(73) Assignees: Racine Co., LTD., Tokyo (JP); Leading Dragon Trading Limited, Hong Kong (CN)

( * ) Notice: Subject to any disclaimer, the term of this patent is extended or adjusted under 35 U.S.C. 154(b) by 0 days.

(21) Appl. No.: 17/771,158

(22) PCT Filed: Oct. 30, 2020

(86) PCT No.: PCT/JP2020/040952
§ 371 (c)(1),
(2) Date: Apr. 22, 2022

(87) PCT Pub. No.: WO2021/205681
PCT Pub. Date: Oct. 14, 2021

(65) Prior Publication Data

US 2022/0369762 A1 Nov. 24, 2022

(30) Foreign Application Priority Data

Apr. 7, 2020 (JP) ..... 2020-069202

(51) Int. Cl.
*A43B 13/14* (2006.01)
*A43B 7/14* (2022.01)
*A43B 17/00* (2006.01)

(52) U.S. Cl.
CPC ..... *A43B 13/143* (2013.01); *A43B 7/14* (2013.01); *A43B 17/00* (2013.01)

(58) Field of Classification Search
CPC ..... A43B 7/14; A43B 17/00; A43B 13/143
See application file for complete search history.

(56) References Cited

U.S. PATENT DOCUMENTS 2,828,555 A * 4/1958 Ledos ..... A43B 7/14 36/176
3,861,398 A * 1/1975 Leydecker ..... A61F 5/14 36/174

(Continued)

FOREIGN PATENT DOCUMENTS

JP 2007-130268 A 5/2007
JP 2009-101139 A 5/2009

(Continued)

*Primary Examiner* — Ted Kavanaugh
(74) *Attorney, Agent, or Firm* — Troutman Pepper Locke LLP

(57) ABSTRACT

To provide an insole capable of effectively inhibiting hallux valgus. An insole in which a heel configured so as to make a human heel arranged higher than a toe when worn is fixed on a back surface side, an upper is fixed on a upper surface side, and an outsole is fixed on the back surface side, the insole having: a stamping-part support part to support a stamping part of a foot of a user; a plantar-arch corresponding part contiguously connected to the stamping-part support part, having a tilt rising toward a rear end part direction, and corresponding to a plantar arch of the foot of the user; and a heel support part contiguously connected to the plantar-arch corresponding part, wherein the heel support part has a concave part to be able to enwrap the heel of the user.

20 Claims, 9 Drawing Sheets

(56) References Cited

U.S. PATENT DOCUMENTS

| | | | | |
|---|---|---|---|---|
| 4,320,588 | A * | 3/1982 | Sottolana | A43B 13/37 36/43 |
| 10,271,612 | B2 * | 4/2019 | Zake | A43B 7/22 |
| 2004/0181976 | A1 * | 9/2004 | Copeskey | A43B 7/143 36/43 |
| 2006/0015050 | A1 * | 1/2006 | Bleau | A43B 7/141 602/28 |
| 2009/0193683 | A1 * | 8/2009 | Igdari | A43B 7/142 36/43 |
| 2015/0257485 | A1 * | 9/2015 | Finkelstein | A43B 13/12 36/43 |
| 2020/0128906 | A1 * | 4/2020 | Fossum | A43B 13/40 |

FOREIGN PATENT DOCUMENTS

| | | | |
|---|---|---|---|
| JP | 4933150 | B2 | 5/2012 |
| JP | 2017-023306 | A | 2/2017 |
| JP | 2018-192181 | A | 12/2018 |

* cited by examiner

SECTIONAL VIEW ALONG A-A LINE

SECTIONAL VIEW ALONG A-A LINE

SECTIONAL VIEW ALONG B-B LINE

SECTIONAL VIEW ALONG C-C LINE

INSOLE

TECHNICAL FIELD

The present invention relates to an insole and, in particular, to an improvement of an insole to be internally inserted into a female shoe in which a heel which makes the human heel arranged higher than the toe when worn and an outsole are fixed on a back surface side and an upper is fixed on a upper surface side.

BACKGROUND ART

Generally, so-called pumps and high heels, which are shoes each having a heel which makes the human heel located higher than the toe part when worn, have been widely used by women.

However, in these pumps and, in particular, high heels, the human heel is located higher than the toe when they are worn, resulting in walking in a state in which most of the body weight of the user is applied as being concentrated on the toe and a stamping part on its heel side.

Therefore, this results in too much loads being applied to the toe side and the stamping part of the foot, and hallux valgus often occurs at aging.

Hallux valgus is a symptom in which the first metatarsal bone is inverted and the hallux is abducted, and pain is caused by a stress on the joint structure of the first metatarsophalangeal joint. In particular, in so-called high heels, the entire body weight is applied to the toe part and the stamping part, and its effect thus tends to be conspicuous.

Thus, to inhibit hallux valgus as described above, insoles of various types have been suggested so far.

CITATION LIST

Patent Literatures

PTL 1: Japanese Unexamined Patent Application Publication No. 2007-130268

PTL 2: Japanese Patent No. 4933150

SUMMARY OF INVENTION

Technical Problem

In view of inhibiting hallux valgus as described above, PTL 1 and PTL 2 each disclose an insole in which a cup-shaped concave part is formed for the human heel portion. The insoles disclosed in PTL 1 and PTL 2 are each made of a synthetic resin, and the cup-shaped concave part is formed in a bow shape in a lateral view having a depth dimension on the order of 3 mm to 4.5 mm.

As a result, the above-described cup-shaped concave part can support the bottom part of the heel of the user, and application of the entire body weight of the user to the toe part can thus be avoided to some extent.

However, in these conventional insoles, since the cup-shaped concave part is formed to have a depth of 3 mm to 4.5 mm, when it is used as being attached to a high heel, the heel of the user cannot be sufficiently supported and the human heel inevitably goes out forward from the cup-shaped concave part during walking and, as a result, the entire body weight is applied to the toe part. From this, there is a trouble that hallux valgus at aging cannot be effectively inhibited.

The present invention was made in view of this problem, and has an object of providing an insole capable of effectively inhibiting hallux valgus even if a shoe is worn having a heel part which makes the human heel located higher than the toe part when worn.

Solution to Problem

To achieve the above-described object, in the invention according to claim 1 is directed to an insole in which a heel configured so as to make a human heel arranged higher than a toe when worn is fixed on a back surface side, an upper is fixed on a upper surface side, and an outsole is fixed on the back surface side, the insole having: a stamping-part support part to support a stamping part of a foot of a user; a plantar-arch corresponding part contiguously connected to the stamping-part support part, having a tilt rising toward a rear end part direction, and corresponding to a plantar arch of the foot of the user; and a heel support part contiguously connected to the plantar-arch corresponding part, wherein the heel support part has a concave part to be able to enwrap the heel of the user.

Therefore, in the invention according to claim 1, at the time of use, the heel of the user is in a state of being enwrapped in the concave part formed in the heel support part of the insole, the heel is securely retained by the heel support part at the time of walking or the like, and a situation in which the heel moves forward from the heel support part can be prevented.

The invention according to claim 2 is directed to the insole according to claim 1, wherein the concave part is formed so as to be capable of accommodating a bottom part and a lateral lower part of the human heel.

Therefore, in the invention according to claim 2, at the time of use, the bottom part and the lateral lower part of the heel of the user are accommodated in the concave part.

The invention according to claim 3 is directed to the insole according to claim 1, wherein the heel support part is formed in a concave shape with entirety swelling downward, and a lowermost part of the heel support part is positioned lower than a boundary portion between the upper and the heel.

The invention according to claim 4 is directed to the insole according to claim 1, wherein the heel support part is formed to have a space dimension between both end parts in a width direction and a lowermost part being equal to or longer than 8 mm and equal to or shorter than 10 mm.

The invention according to claim 5 is directed to the insole according to claim 4, wherein the heel support part is formed so that, when the heel and the outsole are grounded on the grounding surface, the lowermost part of the heel support part is arranged lower than an apex part of the plantar-arch corresponding part.

Therefore, in the invention according to claim 5, the heel support part is formed so that, when the heel and the outsole are grounded on the grounding surface, the lowermost part of the heel support part is arranged lower than an apex part of the plantar-arch corresponding part. This results in that the human heel is arranged lower than the plantar-arch corresponding part.

The invention according to claim 6 is directed to the insole according to claim 5, wherein the heel support part has a heel support concave part formed lower than a general surface of the heel support part.

Therefore, in the invention according to claim 6, when the user wears a shoe with the insole according to the present invention attached thereto, the heel of the user is supported inside the heel support concave part.

The invention according to claim 7 is directed to the insole according to claim 1, wherein the plantar-arch corresponding part forms a relative convex part swelling upward with respect to the heel support part.

Therefore, when the user wears a shoe with the insole according to the present invention attached thereto, the plantar-arch corresponding part makes contact with the plantar arch of the user.

The invention according to claim 8 is directed to the insole according to claim 1, wherein the plantar-arch corresponding part is formed in a convex shape with entirety swelling upward, and is formed in a shape of making contact with a plantar arch of the user when used. Therefore, in the invention according to claim 8, the plantar-arch corresponding part makes contact with the plantar arch of the user when used.

The invention according to claim 9 is directed to the insole according to any one of claim 1 to claim 8, wherein a support edge part protruding upward is formed on a peripheral edge part of the plantar-arch corresponding part and the heel support part.

Therefore, in the invention according to claim 9, the support edge part supports the heel and the plantar arch of the user from the peripheral edge.

The invention according to claim 10 is directed to the insole according to claim 1, wherein the stamping-part support part is formed of a concave part capable of accommodating the stamping part.

Therefore, in the invention according to claim 10, the stamping part of the user is supported inside the stamping-part support part.

The invention according to claim 11 is directed to the insole according to claim 1, wherein the stamping-part support part is formed in a convex shape swelling downward along a width direction, and is formed so as to be capable of accommodating the stamping part.

In the invention according to claim 12, a cross section in a width direction of a heel fixing surface part formed on a back surface side of the heel support part has a radius of curvature equal to or longer than 24 mm and equal to or shorter than 27 mm.

In the invention according to claim 13, a cross section in a width direction of a heel support concave part formed on a upper surface side of the heel support part has a radius of curvature equal to or longer than 40 mm and equal to or shorter than 43 mm.

Advantageous Effects of Invention

In the invention according to claim 1, in an insole in which a heel configured so as to make a human heel arranged higher than a toe when worn is fixed on a back surface side, an upper is fixed on a upper surface side, and an outsole is fixed on the back surface side, the insole having: a stamping-part support part to support a stamping part of a foot of a user; a plantar-arch corresponding part contiguously connected to the stamping-part support part, having a tilt rising toward a rear end part direction, and corresponding to a plantar arch of the foot of the user; and a heel support part contiguously connected to the plantar-arch corresponding part, the heel support part has a concave part to be able to enwrap the heel of the user. At the time of use, the heel of the user is in a state of being enwrapped in the concave part formed in the heel support part of the insole, the heel is securely retained by the heel support part at the time of walking or the like, and a situation in which the heel moves forward from the heel support part can be prevented.

As a result, even if a shoe is worn having a heel which makes the human heel arranged higher than the toe when worn, the body weight of the user can be supported not only by the stamping part but also by the human heel.

Therefore, even if the user walks by wearing the pumps or high heels as before, a situation can be effectively avoided in which the entire body weight of the user is applied only to the stamping part of the foot in a toe direction at the time of walking or the like and, as a result, even with wearing them for a long period of time, occurrence of hallux valgus can be inhibited. Also, with the body weight applied to the entire foot in a balanced manner, fatigue at the time of walking can be effectively reduced.

In the invention according to claim 2, the concave part is formed so as to be capable of accommodating a bottom part and a lateral lower part of the human heel. It is configured that, at the time of use, the bottom part and the lateral lower part of the heel of the user are accommodated in the concave part. In addition to the effect of the invention according to claim 1, the heel of the user is securely retained in the concave part and, even in the pumps or high heels, movement of the heel of the user at the time of use to the toe direction and so forth can be inhibited, and the heel can be securely retained in a state of supporting the body weight of the user.

In the invention according to claim 3, the heel support part is formed in a convex shape with entirety swelling downward, and a lowermost part of the heel support part is configured to be positioned lower than a boundary portion between the upper and the heel. Also, in the invention according to claim 4, the heel support part is formed to have a space dimension between both end parts in a width direction and a lowermost part being equal to or longer than 8 mm and equal to or shorter than 10 mm. Thus, in addition to the effect of the invention according to claim 1, the human heel can be securely supported and, even if the pumps or high heels are worn, the body weight of the user can be retained in a state of being supported not only by the toe part and the stamping part but also by the human heel.

In the invention according to claim 5, the heel support part is formed so that, when the heel and the outsole are grounded on the grounding surface, the lowermost part of the heel support part is arranged lower than an apex part of the plantar-arch corresponding part. Thus, for example, when the user wears a pump or high heel with the insole according to the present invention attached thereto, the position of the human heel is positioned lower than the plantar arch, thereby allowing support of the body weight by the human heel more securely, and the body weight of the user can be retained in a state of being supported not only by the toe part and the stamping part but also by the human heel.

In the invention according to claim 7, the plantar-arch corresponding part forms a relative convex part swelling upward with respect to the heel support part. Also, in the invention according to claim 8, the plantar-arch corresponding part is formed in a convex shape with entirety swelling upward, and is formed in a shape of making contact with a plantar arch of the user when used. Thus when the user wears a shoe with the insole according to the present embodiment attached thereto, the plantar-arch corresponding part makes contact with the plantar arch of the user.

Therefore, as with the human heel, the plantar arch of the user is also positively supported by the insole. Thus, the foot is fixed in a state of not capable of moving forward and backward inside the pump or high heel. The situation can be prevented in which the body weight is applied only to the toe and the stamping part also at the time of walking. This is effective in inhibiting hallux valgus.

In the invention according to claim 9, a support edge part protruding upward is formed on a peripheral edge part of the plantar-arch corresponding part and the heel support part, and the support edge part supports the heel and the plantar-arch of the user from the peripheral edge. Thus, the foot of the user is supported from the periphery by the support edge part. With leftward, rightward, forward, and rearward movements being restricted, a deviation of the foot inside the shoe in a fore-and-aft direction and in a width direction can be reduced, and the body weight can be effectively supported at the toe, the stamping part, and the human heel.

In the invention according to claim 10, the stamping-part support part is formed of a concave part capable of accommodating the stamping part. Also, in the invention according to claim 11, the stamping-part support part is formed in a concave shape with entirety swelling downward so as to be capable of accommodating the stamping part. Thus, the stamping part of the user is supported inside the stamping-part support part, and a deviation of the foot in the fore-and-aft direction is securely restricted.

In the invention according to claim 11, the stamping-part support part is formed in a convex shape swelling downward along a width direction, and is formed so as to be capable of accommodating the stamping part. Thus, the stamping-part support part can be accommodated.

In the invention according to claim 12, a cross section in a width direction of a heel fixing surface part formed on a back surface side of the heel support part has a radius of curvature equal to or longer than 24 mm and equal to or shorter than 27 mm. Thus, since the back surface side of the heel support part has a predetermined curvature, the heel part can be securely fixed.

In the invention according to claim 13, a cross section in a width direction of a heel support concave part formed on a upper surface side of the heel support part has a radius of curvature equal to or longer than 40 mm and equal to or shorter than 43 mm. Thus, the concave part is formed to have a large radius of curvature compared with the conventional insoles capable of enwrap the heel of the user. Together with the radius of curvature of the cross section of the heel fixing surface part in the width direction defined in claim 12, the size of the entire heel portion of the high heel can be decreased in the width direction.

As a result, the width dimension of the heel fixed to the insole can be decreased, and a high heel excellent in design and having an outer appearance with high quality can be fabricated.

DESCRIPTION OF EMBODIMENT

In the following, with reference to the drawings, an embodiment of the present invention is described in detail. However, it is not meant that the scope of the present invention is not limited only to the dimensions, materials, shapes, relative arrangements, and so forth of components described in the present embodiment unless otherwise particularly specified.

Figure 1:
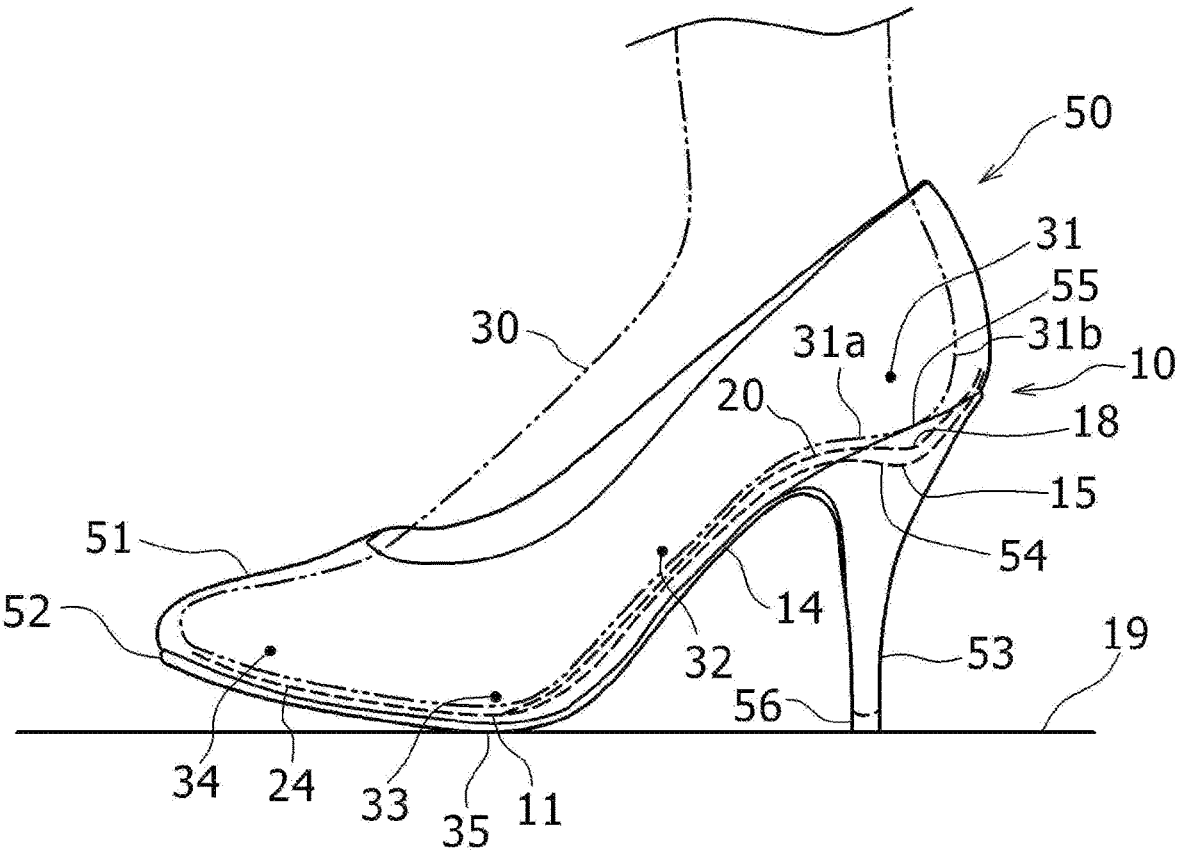
FIG. 1 is a side view depicting a high heel with an insole according to one embodiment of the present invention internally inserted thereinto.

As depicted in FIG. 1, an insole 10 according to the present embodiment is an insole to be internally inserted into a female shoe, for example, a pump or high heel, in which a heel 53 is which makes the human heel arranged higher than the toe when worn is fixed on a back surface side, an upper 51 is fixed on a upper surface side, and an outsole 52 is fixed on the back surface side. In the present embodiment, description is made by taking a high heel 50 as an example.

The high heel 50 includes an insole 10, the heel 53 fixed on the back surface side of a rear end part of the insole 10, the upper 51 attached to the upper surface side of the insole 10, and an outsole 52 fixed on the back surface side of the insole 10.

Also, as will be described further below, in the high heel 50 to which the insole 10 according to the present embodiment is applied, a concave part 54 is formed in an upper end part of the heel 53 and, in the concave part 54, the heel 53 is configured so as to be fixed to the insole 10 with appropriate fixing means.

Figure 2:
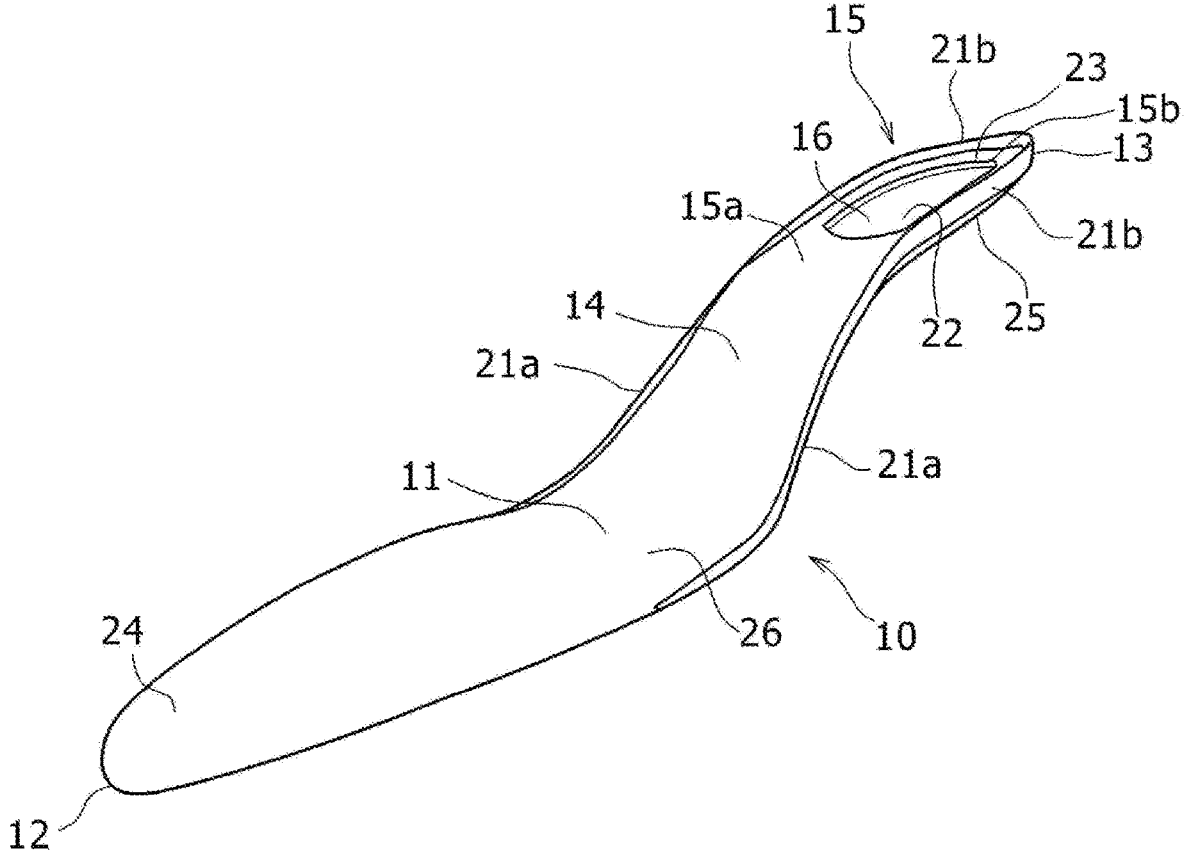
FIG. 2 is a perspective view of the insole according to one embodiment of the present invention in a state when viewed from a front end part side.
Figure 3:
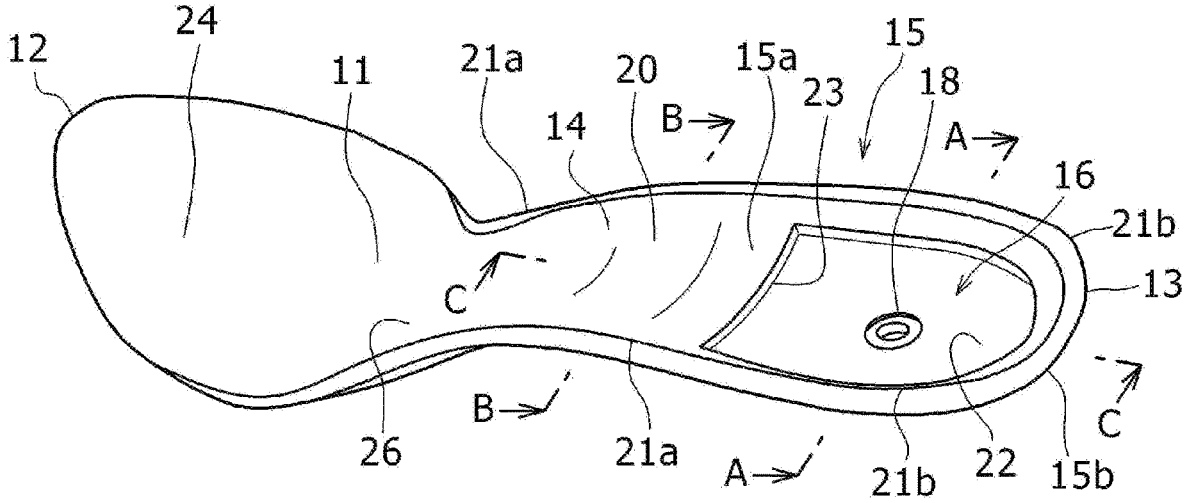
FIG. 3 is a perspective view of the insole according to one embodiment of the present invention in a state when viewed from a rear end part side.

The insole 10 according to the present embodiment is, as depicted in FIG. 2 and FIG. 3, in a substantially plate shape as a whole, and has a toe part 24 which supports the toe of the foot of a user; a stamping-part support part 11 which is contiguously connected to a direction of a rear end part 13 of the toe part 24 and supports the stamping part; a plantar-arch corresponding part 14 which is contiguously connected to a rear end part 13 side of the stamping-part support part 11, is bent upward as having a tilted part which rises toward the direction of the rear end part 13, and corresponds to the plantar arch of the foot of the user; and a heel support part 15 which is contiguously connected to a rear end part 13 side of the plantar-arch corresponding part 14.

The insole 10 according to the present embodiment is made of a synthetic resin, for example, a synthetic resin material such as a polyvinyl chloride resin, polyethylene resin, polyethylene resin, ethylene-vinyl acetate resin, or urethane resin is used, and the insole is formed as being integrally molded by molding.

Note that when a foam of the above-described synthetic resin is used, a cushion insole can be manufactured.

In the insole 10 according to the present embodiment, the toe part 24 and the stamping-part support part 111 are formed in a substantially triangular shape in a planar view.

The plantar-arch corresponding part 14 contiguously connected to the rear end part 13 side of the stamping-part support part 11 is narrowed more than the stamping-part support part 11 to be formed to have a narrow width. The heel support part 15 is formed to have a substantially equal width as that of the plantar-arch corresponding part 14. The rear end part 13 side of the heel support part 15 is formed in a substantially semi-circular shape in a planar view, swelling backward.

The stamping-part support part 11 is formed of a concave part 26 capable of accommodating the stamping part.

Figure 4:
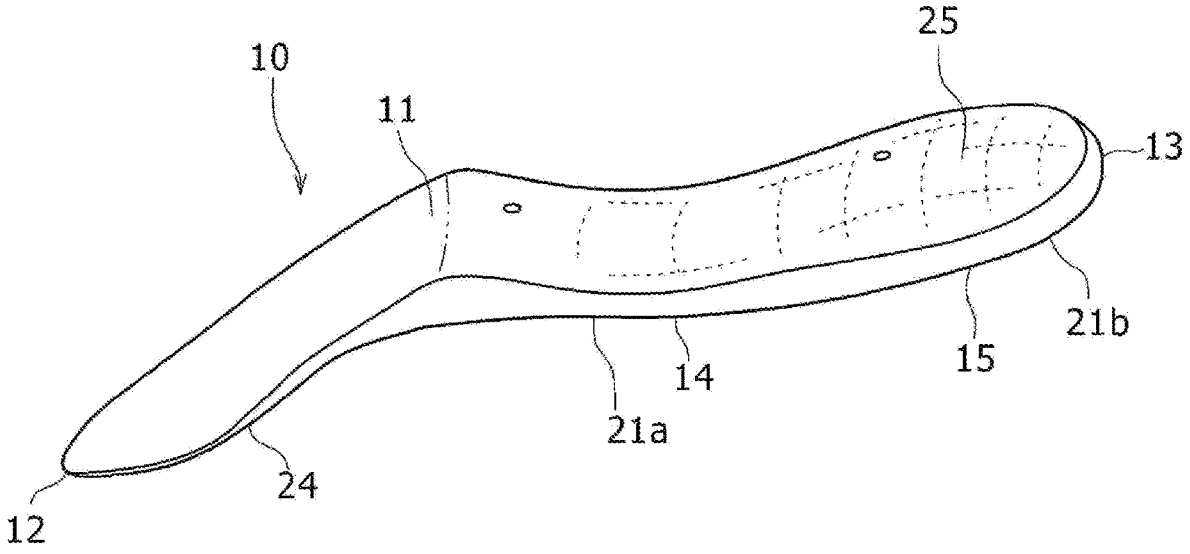
FIG. 4 is a perspective view of the insole according to one embodiment of the present invention from a back surface side.
Figure 6:
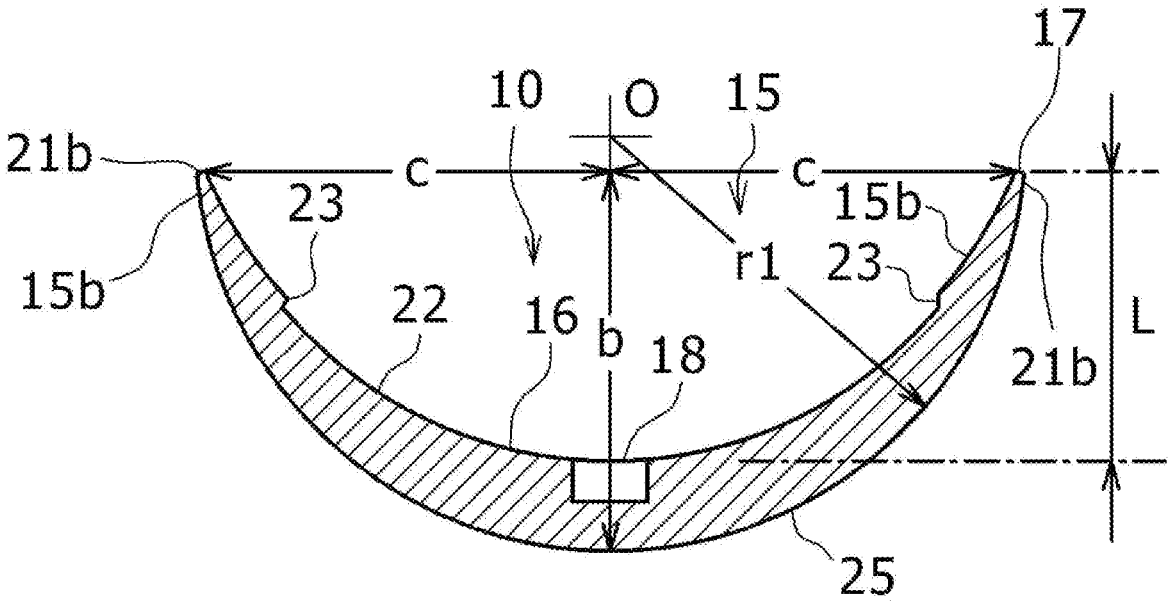
FIG. 6 is a sectional view along an A-A line in FIG. 3, depicting the insole according to one embodiment of the present invention.

In the present embodiment, as depicted in FIG. 4 and FIG. 6, the heel holding part 15 is formed so as to be formed as being greatly bowed downward. And, the heel support part 15 has a concave part 16 which can enwrap the heel of the user to a front surface part side. The concave part 16 is formed so as to be capable of accommodating a bottom part and a lateral lower part of the heel of the user. Also, on a back surface part side, a heel fixing surface part 25 is formed, which includes a bowed surface part swelling downward and having a predetermined radius of curvature.

Note that in the heel 53 to be attached to the insole 10 according to the present embodiment as described above, an upper end part is formed of the concave part 54 for fixing formed to have a radius of curvature equal to the radius of curvature of the heel fixing surface part 25 or milder than the radius of curvature of the heel fixing surface part 25 and is fixed, when the heel 53 is attached to the insole 10, to the heel fixing surface part 25 with a heel nail (not depicted).

Also, the heel support part 15 further has, in the concave part 16, a heel support concave part 22 positioned further lower than a heel-support-part general surface 15*a* and formed with a step part 23.

Figure 8:
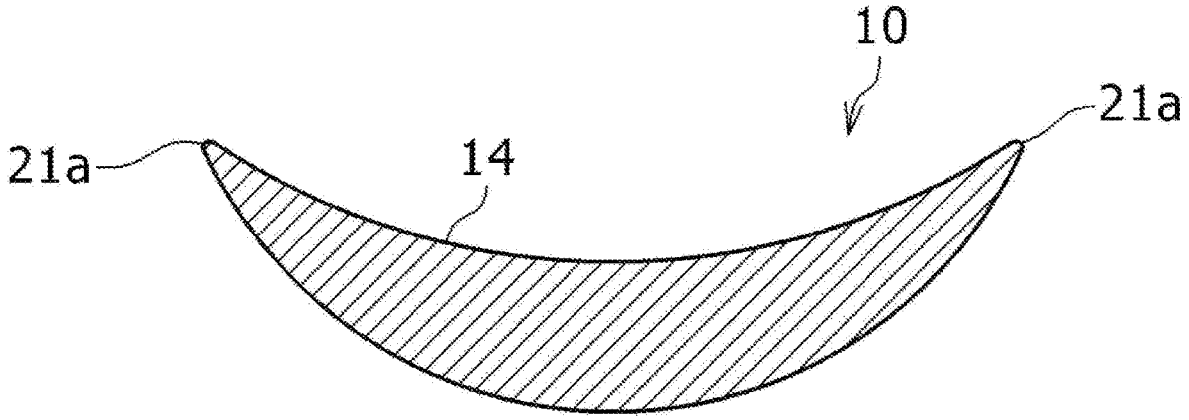
FIG. 8 is a sectional view along a B-B line in FIG. 3, depicting the insole according to one embodiment of the present invention.
Figure 9:
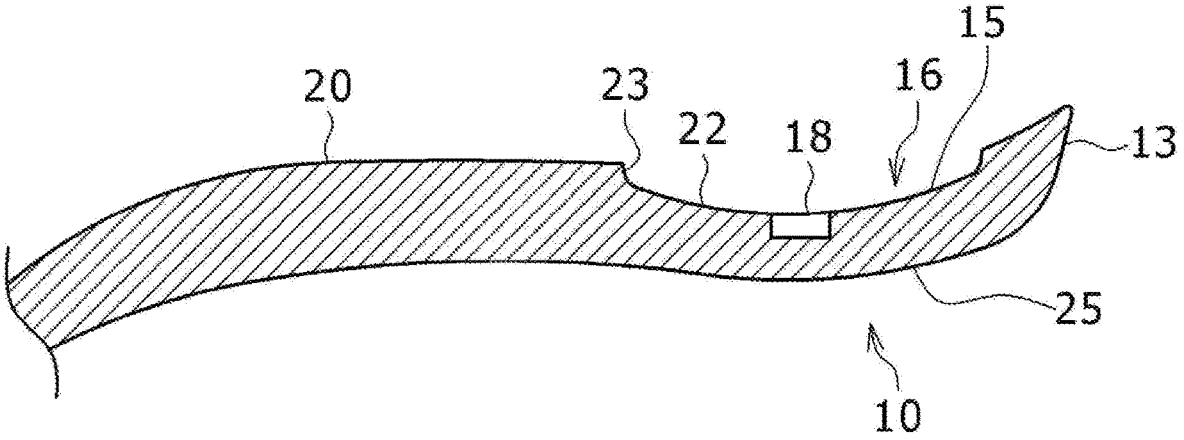
FIG. 9 is a sectional view along a C-C line in FIG. 3, depicting the insole according to one embodiment of the present invention.

As depicted in FIG. 3, FIG. 6, and FIG. 8, the concave part 16 including the heel support concave part 22 is formed, as a whole, in a "bowl shape" having a mild tilt, and has a lowermost part 18 formed at a center part.

This lowermost part 18 forms a center point supporting the body weight acting on the human heel when the user wears a high heel with the insole 10 attached thereto.

In the present embodiment, as depicted in FIG. 6, the heel support part 15 is formed in a concave shape swelling downward as a whole. In the present embodiment, a space dimension L between an upper end part 17 and the lowermost part 18 is formed at 9 mm.

Figure 7:
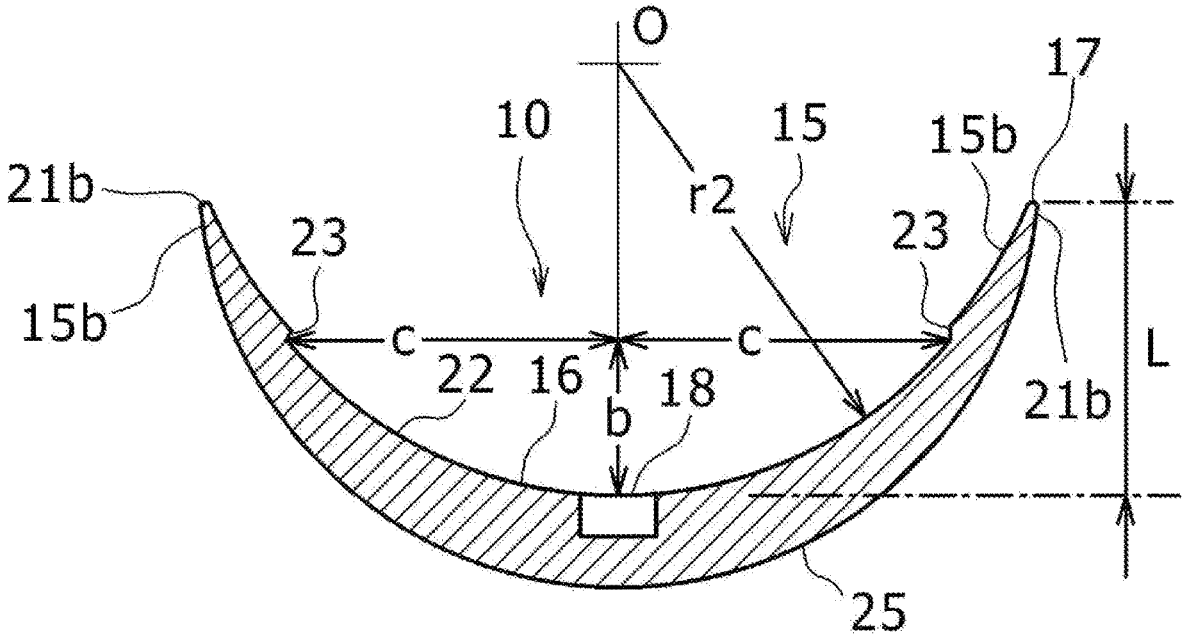
FIG. 7 is a sectional view along the A-A line in FIG. 3, depicting the insole according to one embodiment of the present invention.

As depicted in FIG. 6 and FIG. 7, in a width direction, the heel support part 15 is formed in an arc shape having a larger radius of curvature than the plantar-arch support part 14 contiguously connected to a front end part 12 direction. In the present embodiment, it is configured that a radius of curvature r1 in a cross section in a width direction of the heel support concave part 22 is 41.3 mm, and a radius of curvature r2 in a cross section in a width direction of the heel fixing surface part 25 is 25.7 mm.

The radius of curvature r1 is a radius dimension formed between a virtual center O1 and the heel support concave part 22, and the radius of curvature r2 is a radius dimension formed between a virtual center O2 and the heel fixing surface part 25.

Also, the thickness dimension of the heel support part 15 is formed smaller than the thickness dimension of the plantar-arch contact part 14. As a result, in any portion including a support edge part 21*b* described further below, a peripheral edge part 15*b* of the heel support part 15 in an arc shape in a planar view is formed as rising upward from a general surface of the insole 10, and is configured so that the bottom part and the lateral lower part of the heel of the user are accommodated and enwrapped when used.

When the insole 10 according to the present embodiment is internally inserted into the high heel 50, as described above, the heel 53 is fixed with a heel nail (not depicted), which is appropriate fixing means, on the back surface side of the heel support part 15 in the concave part 54 formed at the upper end part.

In this case, as depicted in FIG. 1, the heel 53, the outsole 52, and the upper 51 are attached to the insole 10 to be arranged on a grounding surface 19 via a grounding part 35 and a top lift 56, the lowermost part 18 of the heel support part 15 is arranged so as to be positioned lower than or at the same height as a boundary line 55 formed at a boundary part between the heel 53 and the upper.

Also as depicted in FIG. 1, the heel support part 15 is formed so that, when internally inserted into the high heel 50 and when the heel 53 and the outsole 52 are grounded on the grounding surface 19 at the grounding part 35, the lowermost part 18 of the heel support part 15 is arranged lower than an apex part 20 of the plantar-arch corresponding part 14.

As depicted in FIG. 2 and FIG. 3, in the present embodiment, to the front end part 12 direction of the heel support part 15, the plantar-arch corresponding part 14 is contiguously connected. The plantar-arch corresponding part 14 is formed in a convex shape with its entirety mildly swelling upward along a length direction. As a result, the plantar-arch corresponding part 14 forms a relatively convex part swelling upward with respect to the heel support part 15.

That is, as depicted in FIG. 1, it is configured that when the insole 10 is internally inserted into the high heel 50 and the heel 53 and the outsole 52 are grounded on the grounding surface 19 at the grounding part 35, in the length direction of the insole 10, the lowermost part 18 of the heel support part 15 has a relationship of being arranged lower than the apex part 20 of the plantar-arch corresponding part 14.

Therefore, as a result, the plantar-arch corresponding part 14 forms a relatively convex part protruding upward with respect to the heel support part 15. As a result, when the user wears the high heel 50 with the insole 10 according to the present embodiment internally inserted thereinto, the plantar-arch corresponding part 14 makes contact with the plantar arch of the user.

Figure 5:
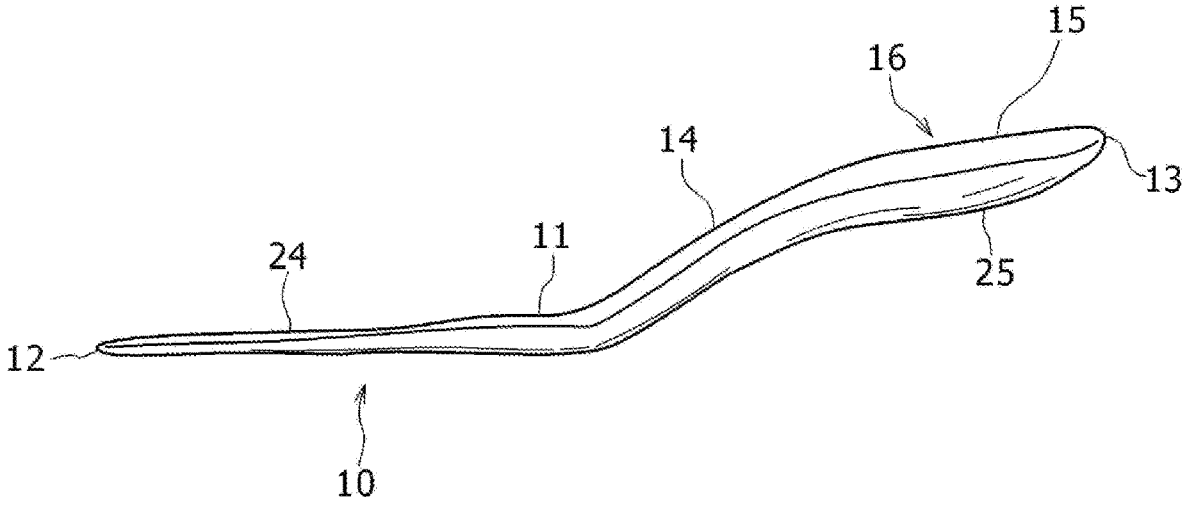
FIG. 5 is a side view depicting the insole according to one embodiment of the present invention.

Also as depicted in FIG. 8 and FIG. 5, the plantar-arch corresponding part 14 is formed so as to draw an arc shape swelling downward and having a radius of curvature milder than that of the heel support part 15 in a width direction.

Also as depicted in FIG. 2 and FIG. 3, and FIG. 5, a support edge part 21 protruding upward is formed on a peripheral edge part of the plantar-arch corresponding part 14 and the heel support part 15.

While this support edge part 21 forms, in the plantar-arch corresponding part 14, a support edge part 21*a* extending along a planar direction of the plantar-arch corresponding part 14, the support edge part 21*a* gradually rises to be extended from the plantar-arch corresponding part 14 to the heel support part 15 and becomes in a nearly upright posture in the heel support part 15 to be arranged as a standing support edge part 21*b*.

On a front end part 12 side of the plantar-arch corresponding part 14, the stamping-part support part 11 is provided to be extended. As depicted in FIG. 1, FIG. 4, and FIG. 5, in the present embodiment, the stamping-part support part 11 is formed as a convex part swelling downward along the entire width direction and is configured to be capable of accommodating the stamping part of the foot of the user. Also, on a tip part 12 side of the stamping-part support part 11, the toe part 24 in a flat plate shape is further provided to be extended.

In the following, the operation of the insole 10 according to the present embodiment is described.

As depicted in FIG. 1, when the insole 10 according to the present embodiment is used to fabricate the high heel 50, in a state in which the concave part 54 formed at the upper end part of the heel 53 is brought into contact with the heel fixing surface part 25 on the back surface side of the heel support part 15 of the insole 10, the heel 53 is fixed to the insole 10 via the appropriate heel nail (not depicted).

Thereafter, the top lift 56 is fixed at a tip part of the heel 53, and the upper 51 and the outsole 52 are fixed to the insole 10 as appropriate, and the high heel 10 is thereby fabricated.

In this case, as described above, any portion, including the support edge part 21*b*, of the peripheral edge part 15*b* of the heel support part 15 in an arc shape in a planar view is formed as rising upward from a general surface of the insole 10 and is configured to accommodate and enwrap a bottom part 31*a* and a lateral lower part 31*b* of a human heel 31 of the user when used. From this, the human heel 31 is stably retained in the heel support part 15.

As a result, even in walking as wearing the high heel 50, stable walking can be made. Also, with the position of the human heel being fixed, fatigue can be reduced even in longtime walking.

Also, the lowermost part 18 of the heel support part 15 is arranged so as to be positioned lower than the boundary line 55 formed at the boundary part between the heel 53 and the upper 51, and the heel support part 15 is formed so that, when internally inserted into the high heel 50 and when the heel 53 and the outsole 52 are grounded on the grounding surface 19 such as the ground via the grounding part 35, the lowermost part 18 of the heel support part 15 is arranged lower than the apex part 20 of the plantar-arch corresponding part 14. From this, the human heel 30 of the user can support the body weight of the user at the heel support part 15.

As a result, a conventional situation can be eliminated in which, with a foot 30 in a high heel moved forward, the body weight of the user is applied as being concentrated on a toe part 34 and a stamping part 33. Since the body weight of the user is also supported at the human heel 31, the body weight can be supported as being distributed also in the high heel.

Therefore, hallux valgus, which is conventionally caused by the body weight of the user applied as being concentrated only on the toe 34 and the stamping part 33 when a high heel is worn, can be effectively inhibited.

Also, the heel fixing surface part 25 formed of a bowed surface part swelling downward is formed on the back surface part side of the heel support part 15, and is thus formed to have a large radius of curvature in a cross section in the width direction compared with a conventional insole so as to be able to enwrap the heel of the user, thereby allowing a decrease in the size of the entire heel portion of the high heel in the width direction. As a result, the width dimension of the heel 53 fixed to the insole 10 can be decreased, and a high heel excellent in design and having an outer appearance with high quality can be fabricated.

Also in the present embodiment, the plantar-arch corresponding part 14 is formed in a convex shape with its entirety mildly swelling upward along the length direction and, as a result, the plantar-arch corresponding part 14 forms a relatively convex part swelling upward with respect to the heel support part 15. Thus, at the time of wearing by the user, the plantar-arch support part 14 makes contact with a plantar arch 32 of the foot 30 of the user.

As a result, the plantar arch 32 of the user is also supported by the insole 10. Thus, the foot is fixed in a state of resisting being moved forward and rearward in the high heel 50. Thus, the situation can be prevented in which the body weight is applied only to the toe 34 and the stamping part 33 at the time of walking, and hallux valgus can be more effectively inhibited.

Furthermore, in the present embodiment, the stamping-part support part 11 is formed as a concave part swelling downward along the entire width direction and is configured so as to be capable of accommodating the stamping part 33 of the foot of the user. Thus, in the stamping part 33, the foot 30 is securely retained and is retained in a state of resisting being moved forward and rearward inside the high heel 50.

As a result, the stamping-part support part 11 contributes to keeping a state in which the human heel 31 is retained in the heel support part 15 as described above. Thus, also with the stamping-part support part 11, hallux valgus can be inhibited and fatigue at the time of walking can be reduced.

In the present embodiment, description has been made to a case as an example in which the insole 10 is applied to a high heel. However, it may be applied to a so-called pump and, furthermore, another shoe of a similar form, and the present embodiment is not restrictive.

In the present embodiment, description has been made to a case as an example in which the lowermost part 18 of the heel support part 15 is arranged so as to be positioned lower than the boundary line 55 formed at the boundary part between the heel 53 and the upper 51. However, the present embodiment is not restrictive, and the lowermost part 18 of the heel support part 15 may be configured so as to be arranged at the same height position as the boundary line 55 formed at the boundary part between the heel 53 and the upper 51.

While the present embodiment has been described in the foregoing, the present invention is not limited to the present embodiment and can be implemented as being variously modified in a scope not deviating from the gist of the invention.

INDUSTRIAL APPLICABILITY

The present invention has industrial applicability because of being widely applicable to insoles.

REFERENCE SIGNS LIST

10: insole
11: stamping-part support part
12: front end part
13: rear end part
14: plantar-arch support part
15: heel support part
15*a*: general surface of the heel support part
16: concave part
17: upper end part
18: lowermost part
19: grounding surface (ground)
20: apex part
21: support edge part
22: heel support concave part
23: step part
24: toe part
25: heel fixing surface part
26: concave part

30: foot
31: human heel
31*a*: bottom part
31*b*: lateral lower part
32: plantar arch
33: stamping part
34: toe part
35: grounding part
50: high heel
51: upper
52: outsole
53: heel
54: concave part
55: boundary portion
56: top lift
L: space dimension

The invention claimed is:

1. An insole for a shoe with an upper, an outsole and a heel configured so as to make a human heel arranged higher than a toe when worn, the insole comprising:

a stamping-part support part to support a stamping part of a foot of a user;

a plantar-arch corresponding part contiguously connected to the stamping-part support part, having a tilt rising toward a rear end part direction, and corresponding to a plantar arch of the foot of the user; and a heel support part contiguously connected to the plantar-arch corresponding part, wherein the heel support part has a concave part to be able to enwrap the heel of the user, and the concave part includes a concave region that is lower than a general surface of the heel support part and is formed with a step part, wherein the concave part also includes a lowermost part which comprises a further recessed region that is formed at a center part of the concave region of the concave part.

2. The insole according to claim 1, wherein the concave part is formed so as to be capable of accommodating a bottom part and a lateral lower part of the human heel.

3. The insole according to claim 2, wherein a support edge part protruding upward is formed on a peripheral edge part of the plantar-arch corresponding part and the heel support part.

4. The insole according to claim 1, wherein the heel support part is formed in a concave shape with entirety expanding downward, and the lowermost part of the heel support part is positioned lower than a boundary portion between the upper and the heel when the insole is inserted in the shoe.

5. The insole according to claim 4, wherein a support edge part protruding upward is formed on a peripheral edge part of the plantar-arch corresponding part and the heel support part.

6. The insole according to claim 1, wherein the heel support part is formed to have a space dimension between an upper end part and the lowermost part of being equal to or longer than 8 mm and equal to or shorter than 10 mm.

7. The insole according to claim 6, wherein a support edge part protruding upward is formed on a peripheral edge part of the plantar-arch corresponding part and the heel support part.

8. The insole according to claim 6, wherein the heel support part is formed so that, when the insole is inserted in the shoe and the heel and the outsole of the shoe are grounded on a grounding surface, the lowermost part of the heel support part is arranged lower than an apex part of the plantar-arch corresponding part.

9. The insole according to claim 8, wherein a support edge part protruding upward is formed on a peripheral edge part of the plantar-arch corresponding part and the heel support part.

10. The insole according to claim 1, wherein the plantar-arch corresponding part forms a relative convex part expanding upward with respect to the heel support part.

11. The insole according to claim 1, wherein the plantar-arch corresponding part is formed in a convex shape along a length direction and with entirety expanding upward, and is formed in a shape of making contact with a plantar arch of the user when used.

12. The insole according to claim 1, wherein a support edge part protruding upward is formed on a peripheral edge part of the plantar-arch corresponding part and the heel support part.

13. The insole according to claim 1, wherein the stamping-part support part is formed of a concave part capable of accommodating the stamping part.

14. The insole according to claim 1, wherein a cross section in a width direction of a heel fixing surface part formed on a back surface side of the heel support part has a radius of curvature equal to or longer than 24 mm and equal to or shorter than 27 mm.

15. The insole according to claim 1, wherein a cross section in a width direction of the concave region has a radius of curvature equal to or longer than 40 mm and equal to or shorter than 43 mm.

16. The insole according to claim 1, wherein the step part of the concave part forms an outer boundary of the concave region within the heel support part.

17. The insole according to claim 16, wherein the outer boundary of the concave region has a shape corresponding to a general shape of the heel support part.

18. A shoe comprising:

an upper;

an outsole;

a heel configured so as to make a human heel arranged higher than a toe when worn; and an insole comprising:

a stamping-part support part to support a stamping part of a foot of a user, a plantar-arch corresponding part contiguously connected to the stamping-part support part, having a tilt rising toward a rear end part direction, and corresponding to a plantar arch of the foot of the user, and a heel support part contiguously connected to the plantar-arch corresponding part, wherein the heel support part has a concave part to be able to enwrap the heel of the user, and the concave part includes a concave region that is lower than a general surface of the heel support part and is formed with a step part, wherein the concave part also includes a lowermost part which comprises a further recessed region that is formed at a center part of the concave region of the concave part.

19. The shoe according to claim 18, wherein the heel support part is formed in a concave shape with entirety expanding downward, and the lowermost part of the heel support part is positioned lower than a boundary portion between the upper and the heel.

20. A shoe comprising:

an upper;

an outsole;

a heel configured so as to make a human heel arranged higher than a toe when worn; and an insole comprising:

a stamping-part support part to support a stamping part of a foot of a user, a plantar-arch corresponding part contiguously connected to the stamping-part support part, having a tilt rising toward a rear end part direction, and corresponding to a plantar arch of the foot of the user, and a heel support part contiguously connected to the plantar-arch corresponding part, wherein the heel support part has a concave part to be able to enwrap the heel of the user, and the concave part includes a concave region that is lower than a general surface of the heel support part and is formed with a step part, wherein the lowermost part of the heel support part of the insole is arranged lower than an apex part of the plantar-arch corresponding part of the insole, and wherein the concave part also includes a lowermost part which comprises a further recessed region that is formed at a center part of the concave region of the concave part.

* * * * *